US005752847A

United States Patent [19]

McCormick

[11] Patent Number: 5,752,847

[45] Date of Patent: May 19, 1998

[54] CLOSE TOLERANCE QUICK DISCONNECT ELECTRICAL CONNECTOR

[75] Inventor: Larry L. McCormick, Camarillo, Calif.

[73] Assignee: G & H Technology, Inc., Camarillo, Calif.

[21] Appl. No.: 676,474

[22] Filed: Jul. 8, 1996

[51] Int. Cl.[6] ..... H01R 13/627

[52] U.S. Cl. ..... 439/349; 439/310

[58] Field of Search ..... 439/349, 345, 439/140, 142, 310, 289

[56] References Cited

U.S. PATENT DOCUMENTS 2,761,111 8/1956 Klostermann ..... 439/349

4,422,704 12/1983 Williams ..... 439/349

5,334,032 8/1994 Myers et al. ..... 439/140

5,575,675 11/1996 Endo et al. ..... 439/310

*Primary Examiner*—Hien Vu

*Attorney, Agent, or Firm*—George J. Netter

[57] ABSTRACT

A plug (12) and receptacle (14) connector has its unmating force determined in part by a generally circular helical spring (20) received in a slot (22) on one of the connector parts which resiliently resists separation by engaging a ridge (18) on the other connector part. A pressure ring (26) also exerts a selectively adjustable separation force on the connector parts serving to fine tune the summation actual separation force to a precise predetermined value.

5 Claims, 1 Drawing Sheet

FIG. 1
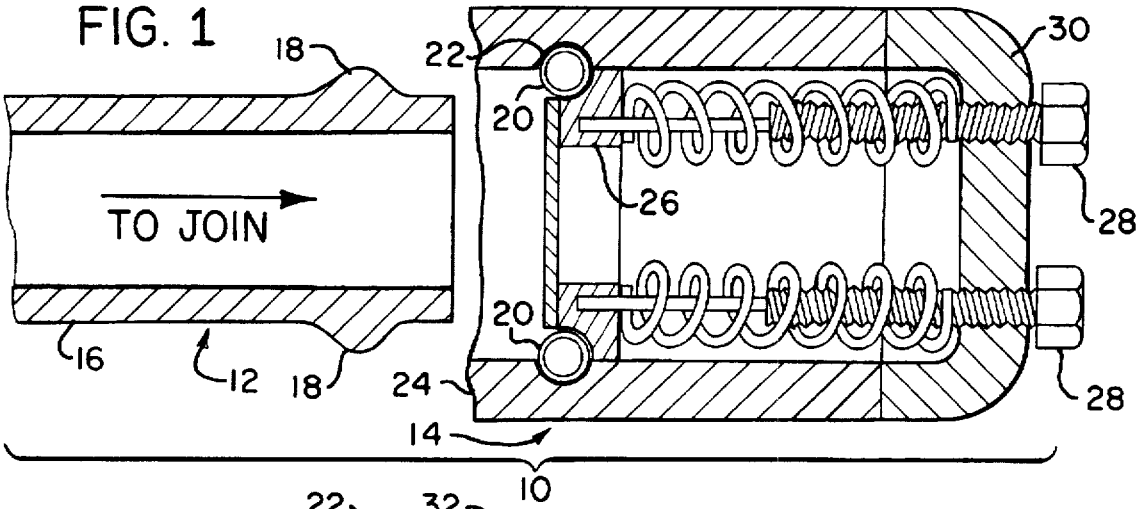
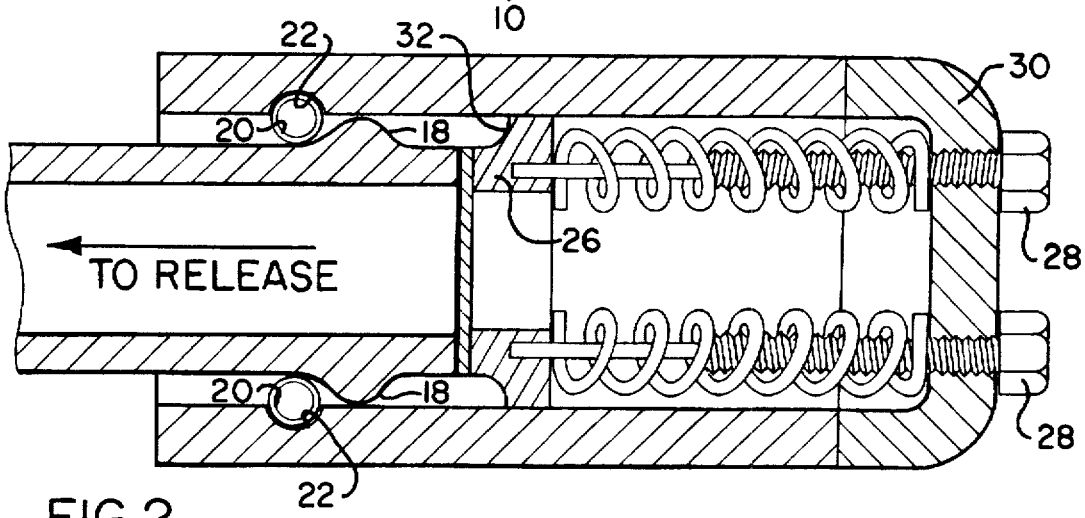
FIG.2
FIG. 3
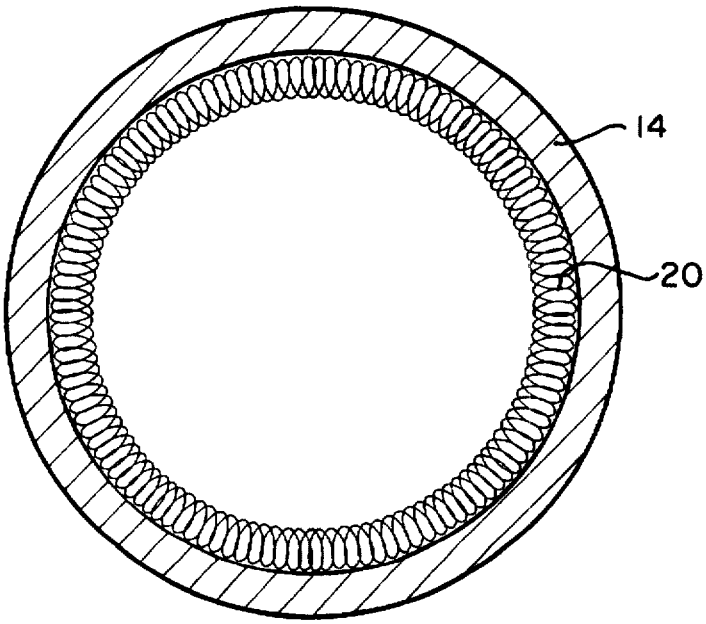

CLOSE TOLERANCE QUICK DISCONNECT ELECTRICAL CONNECTOR

BACKGROUND

1. Background of the Invention

The present invention relates to an electrical connector requiring reliable disconnection or demating when a releasing force is applied exceeding a predetermined relatively precise threshold value.

2. Description of Related Art

There are many situations (e.g., fire control equipment) in which it is necessary that an electrical connector be disconnected when subjected to a releasing force exceeding some predetermined minimum amount. Various types of spring-loaded restraints have been suggested in which a connector consisting of a pair of shell-like members telescopingly received onto each other has release control embodied in a compression spring engaging the members which must be overcome before the connector parts can be separated. However, all of the known devices of this character suffer from having a sufficiently wide range of tolerance variation experienced from one connector to another as to make the disconnect means substantially unreliable in a specific designed-for-use context.

It is, therefore, a desideratum to provide a means incorporated into an electrical connector or other device have mechanically separable parts enabling the various parts to be reliably unmated on application of a specific predetermined amount of separating force.

SUMMARY OF THE INVENTION

The electrical connector with which the present invention is most advantageously employed includes receptacle and plug parts having shell-like housings which telescopingly fit together in order to effect interconnection of one or a plurality of pin and socket wire connectors, for example.

It is a primary aim and object of the present invention to provide a means for achieving full disconnect of plug and receptacle parts from each other when the withdrawing force exceeds a predetermined minimum value, which release of the parts can be selectively controlled within a given tolerance range.

The inner surface of the outermost shell includes a circumferentially extending slot within which a continuous circular coil spring is located, which spring has been selected to provide a given amount of resilient obstruction or resistance force to attempted unmating of the connector parts. On the outer end portion of the inner connector shell there is provided a protruding continuously curved flange or ridge having entrance and exit male ramp portions. When the connector parts are mated to one another, the coil spring moves up the entrance ramp of the flange on the other connector part and then down the exit ramp to reside closely adjacent the flange when the connector is in fully mated condition. Removal of the one connector part from the other, will accordingly require a certain amount of separating force directly and primarily determined by the characteristics of the coil spring.

Although a coil spring can be made having prescribed characteristics, it is difficult to manufacture such coil springs in quantity and maintain precise spring-like characteristics in use without manufacturing costs becoming unreasonably high. In addition, the overall tolerances of the connector can vary considerably so that even if the spring characteristics are exact according to design specifications, it may be found that different shell parts provide frictional drag on mating and demating, and individual pin contacts of a given connector may be bent so as to increase frictional force over design specifications. All of these matters require compensation to control accurately the separation force for a given connector.

As a tuning means to bring the connector release force within the prescribed tolerance range, in accordance with the present invention, a plurality of spring-loaded members drive a pressure ring which exerts a resilient force against the inner end of the internal connector part shell of selectively adjustable amount. By adjusting the spring tension of the ring the overall connector separating force can be changed accordingly and compensation for changing characteristics of different connectors can be readily obtained.

BRIEF DESCRIPTION OF THE DRAWING

FIG. 1 is a side elevational, partially sectional view of the invention showing the parts separated;

FIG. 2 is a side elevational view of the described invention showing the parts mated;

FIG. 3 is an end elevational view taken along the line 3—3 of FIG. 1.

DESCRIPTION OF A PREFERRED EMBODIMENT

Turning now to the drawings and particularly FIG. 1, there is shown an electrical connector of the present invention enumerated generally as 10 including a cylindrical plug 12 and receptacle 14 which telescopingly fit together in a conventional known manner. As will be shown, the connector to be described is so constructed that the connector parts 12 and 14 can be readily separated from one another by applying a force in the direction of the arrows which exceeds some precise predetermined value. Moreover, the connector can be specifically adjusted to compensate for changes in the necessary force to release the connector that may arise from unforeseen events (e.g., bent pin contact).

The plug 12 includes a generally cylindrical housing 16 with a flange or ridge 18 extending radially outwardly and continuously about the shell periphery. The ridge has a curved outer surface with an entrance beveled ramp and as well a beveled exit ramp. The ridge is located at a predetermined suitable distance from the outer end of the plug shell for coaction with the receptacle shell as will be described. Typically, the interior of the plug shell contains electrical contacts, such as pin contacts or socket contacts; however, since the quantity, nature and operation of these contacts are not a part of this invention they are not shown.

As can be seen in FIG. 1, a ring-shaped helical spring or garter spring 20 is positioned within a receiving slot 22 on the interior surface of the receptacle shell spaced back from the shell entrance end 24 so as to provide a complementary coactive relationship with ridge 18 upon mating to the plug connector. The depth of the slot 22 is such as to permit the receptacle and plug parts to be mated together during which the spring will move over the entrance ramp and ridge to be positioned on the back side or exit ramp of the ridge (FIG. 2). To disconnect the connector parts, the force applied in the direction of the arrows has to be sufficiently strong to primarily overcome the retarding force presented by the spring contacting the ridge. In manufacture, such a spring can be made relatively accurately to any given spring characteristics. However, close tolerance of manufacture can increase the price of the spring prohibitively. Also, there are other matters that can contribute to the force necessary to separate any given connector (e.g., bent pin contacts, friction of connector shell contacting parts), so that even where the spring characteristics are maintained precisely constant from connector to connector, compensation for these other matters is necessary.

A pressure ring 26 has an outer diameter such as to enable sliding receipt within the spring 20 central opening when the parts are in the unmated condition (FIG. 1). At least one and preferably a plurality of spring-loaded bolts 28 are threaded through an outer end cover 30 of the receptacle and rotatably connected at their inner end onto the back of the ring. The amount of compression applied to the various springs can change by merely adjustable threading the bolts 28 within the cover 30 which, in turn, increases or lessens the amount of spring force that will be applied by the ring 26 to the plug end, as the case may be.

Accordingly, on mating of the plug 12 and receptacle 14 connector parts, the outer end surface of the pressure ring 26 initially contacts the outer end of the plug shell such that on further mating force being applied the springs on the bolts are placed into further compression until the maximum preset amount is reached. Also, at the same time, the garter spring moves toward and over the ridge 18 and finally rests on the back side of the ridge in locking relation for the connector.

When it is desired to disconnect the connector, the two parts are moved apart from one another in accordance with the arrows in FIG. 2, with sufficient force being applied to exceed that transverse resistance provided by the garter spring reacting with the ridge and modified by the force of the fine tuning springs according to the adjustment of the bolts 28.

When the connector parts are separated, the pressure ring 26 is positioned at its forwardmost partially covering the spring 20 and holding it within the slot 22. In particular, the front or forward face of the ring includes a continuous indentation 32 of concave curvature for fitting against the spring and which aids in holding the spring within the slot.

More particularly as to operation of the described apparatus, in many systems, as fire control systems, it is necessary in an emergency that different parts of the system be electrically disconnected quickly and reliably. This is quite frequently accomplished by physically separating a releasable electrical connector, such as a plug and receptacle connector, that is located in an interconnection circuit between system parts. According to system design, it will be determined that such an electrical connector must separate to reliably interrupt the electric circuit upon application of a separating force exceeding some given design value by even a relatively small amount. The coaction of the garter spring 20 and finely tuned spring load on the pressure ring 26 as previously described assures that the release force is within the desired acceptable range including compensating for idiosyncracies of frictional engagement between connector parts.

Although the present invention is described in connection with a preferred embodiment, it is to be understood that those skilled in the appertaining arts may effect changes that come within the scope of the invention as described and within the ambit of the appended claims.

What is claimed is:

1. An electrical connector with adjustable releasing force, comprising:

a plug and receptacle telescopingly matable;

a continuous slot formed in a wall surface of the receptacle facing the plug;

an annular helical spring positioned within the slot with portions of said spring extending outwardly of the slot;

a ridge on a surface of the plug which contacts said spring portions during mating and releasing;

a pressure ring movably mounted within the receptacle and contacting the plug on mating; and a spring-loaded bolt mounted within the receptacle resiliently urging the ring against the helical spring into the slot when the receptacle and plug are released and the ring contacts the plug urging the ridge against the helical spring portions with a predetermined force when the plug and receptable are mated.

2. An electrical connector as in claim 1, in which the ridge includes first and second beveled ramps on opposite sides of the ridge which are contacted by the helical spring during joining and releasing of the plug and receptacle.

3. An electrical connector as in claim 1, in which the helical spring is arranged in a continuous closed loop.

4. An electrical connector as in claim 1, in which said ring includes a continuous indentation which contacts the helical spring to hold it within the slot when the plug and receptacle are separated from one another.

5. An electrical connector preventing release of matable parts unless a releasing force exceeding a relatively precise predetermined amount is applied, comprising:

a receptacle and plug telescopingly related to one another for mating and release;

a circular slot formed in an internal wall surface of the receptacle;

an annular helical spring positioned within the slot having portions extending outwardly of the slot;

a circular ridge on an outer surface of the plug compressingly contacting the helical spring during joining and releasing movement of the plug and receptacle and resisting release from mated condition with a certain predetermined force; and a pressure ring and an adjustable spring-loaded bolt mounting said ring in the receptacle for exerting a selectively adjustable force against the plug, the combined forces of the spring-loaded bolt and the annular helical spring setting the precise predetermined releasing force required.

* * * * *